United States Patent [19]

Reichman et al.

[11] 4,396,073

[45] Aug. 2, 1983

[54] UNDERGROUND BORING APPARATUS WITH CONTROLLED STEERING CAPABILITIES

[75] Inventors: James M. Reichman, Issaquah; Douglas P. Kelley, Redmond, both of Wash.

[73] Assignee: Electric Power Research Institute, Inc., Palo Alto, Calif.

[21] Appl. No.: 303,585

[22] Filed: Sep. 18, 1981

[51] Int. Cl.[3] ..... E21B 7/08

[52] U.S. Cl. ..... 175/74; 175/61; 92/71

[58] Field of Search ..... 175/74, 73, 61, 256; 285/118; 92/71, 61, 146

[56] References Cited

U.S. PATENT DOCUMENTS

| | | | |
|---|---|---|---|
| 2,271,005 | 1/1942 | Grebe | 175/61 |
| 2,345,766 | 4/1944 | Miller | 285/118 X |
| 2,891,769 | 6/1959 | Page, Sr. et al. | 175/76 |
| 3,043,381 | 7/1962 | McNeely, Jr. | 175/73 |
| 3,138,213 | 6/1964 | Brandon | 175/65 |
| 3,326,008 | 6/1967 | Baran et al. | 175/61 |
| 3,677,354 | 7/1972 | Kostylev et al. | 175/76 |
| 4,046,204 | 9/1977 | Takaoka et al. | 175/76 |
| 4,095,655 | 6/1978 | Still | 175/19 |

*Primary Examiner*—Ernest R. Purser
*Assistant Examiner*—Thuy M. Bui
*Attorney, Agent, or Firm*—Flehr, Hohbach, Test, Albritton & Herbert

[57] ABSTRACT

An underground boring apparatus including a forwardmost boring head is disclosed herein along with a particular technique for guiding the boring head through the earth along both linear and non-linear paths. In a specific embodiment, the apparatus utilizes an elongated shaft arrangement supporting the boring head at its front end and a tubular housing supporting an intermediate segment of said shaft arrangement for pivotal movement about one of a number of different axes whereby to cause the boring head to pivot relative to the housing. An arrangement of piston/cylinder units is disposed within the housing for pivoting the shaft arrangement in a controlled fashion whereby to determine the direction of movement of the boring head through the earth. This arrangement of piston/cylinder units not only serves to maintain the shaft arrangement and boring head in a pivoted position for causing the latter to move in a curved path, but also serves to maintain the shaft arrangement and boring head in coaxial relationship with the tubular housing for causing the boring head to follow a straight line path.

8 Claims, 7 Drawing Figures

UNDERGROUND BORING APPARATUS WITH CONTROLLED STEERING CAPABILITIES

The present invention relates generally to systems or apparatus for boring holes underground utilizing a given boring head and more particularly to a specific technique for guiding or steering the boring head as the latter moves through the ground.

Underground boring systems whether for general drilling purposes or for laying underground cable are well known in the art. Some of these systems are designed merely to move their respective boring heads in straight line paths through the ground and hence do not require very complicated guiding or steering mechanisms. On the other hand, other systems are specifically designed to guide their respective boring heads along controlled linear and non-linear paths through the ground. The guiding or steering mechanisms utilized with these latter systems are generally more complex.

However, it is an object of the present invention to provide an underground boring apparatus which is designed to move its associated boring head through the earth in a guided, linear or non-linear path utilizing a guiding or steering technique which is uncomplicated in design and reliable in use.

Another object of the present invention is to provide a steering technique which acts in a positive fashion to ensure that the boring head moves along a straight line path when this is desired, even though the overall apparatus has the capability to move the boring head non-linearly.

Still another object of the present invention is to provide a steering technique capable of guiding the boring head along any one of a number of different curved paths.

Yet another object of the present invention is to provide a steering technique capable of moving the boring head about curved paths having relatively small turning radii.

As will be seen hereinafter, the underground boring system disclosed herein is one which includes a boring head, elongated means connected at its front end to and extending rearwardly from the boring head for supporting the latter, and means supporting the elongated means at a predetermined point along the length of the latter for pivotal movement about at least one axis whereby to also cause the boring head to pivot about the same axis. The apparatus also includes means for pivoting the supporting means about this axis in a controlled fashion and for maintaining the latter in any one of its pivoted positions so as to guide the boring head through the earth as the latter is moved in a generally forward direction.

In a preferred and actual working embodiment of the present invention, the elongated means, specifically an elongated shaft arrangement, is pivoted within a tubular housing which contains a back end segment of the shaft arrangement and which also contains the means for pivoting the arrangement. In this particular embodiment, an arrangement of piston/cylinder units disposed within the tubular housing behind the shaft arrangement forms part of the pivoting means. The pistons are designed to move relative to one another in a controlled fashion for causing the boring head to turn or in synchronism, again in a controlled fashion, for causing the boring head to remain in a straight line path of movement. The tubular housing itself has an outermost surface which tapers outwardly from its opposite ends to a central point such that the cross sectional size of the housing at this latter point is approximately the same size as the maximum cross sectional configuration of the boring head. In this way, as the boring head and its support shaft are caused to pivot in one direction, the tubular housing pivots in the opposite direction about its central point, thereby allowing the boring head to make a sharper turn than would be possible if the housing were not allowed to pivot in this manner.

These and other features of the underground boring apparatus disclosed herein will be discussed in more detail hereinafter in conjunction with the drawings wherein.

Figure 1:
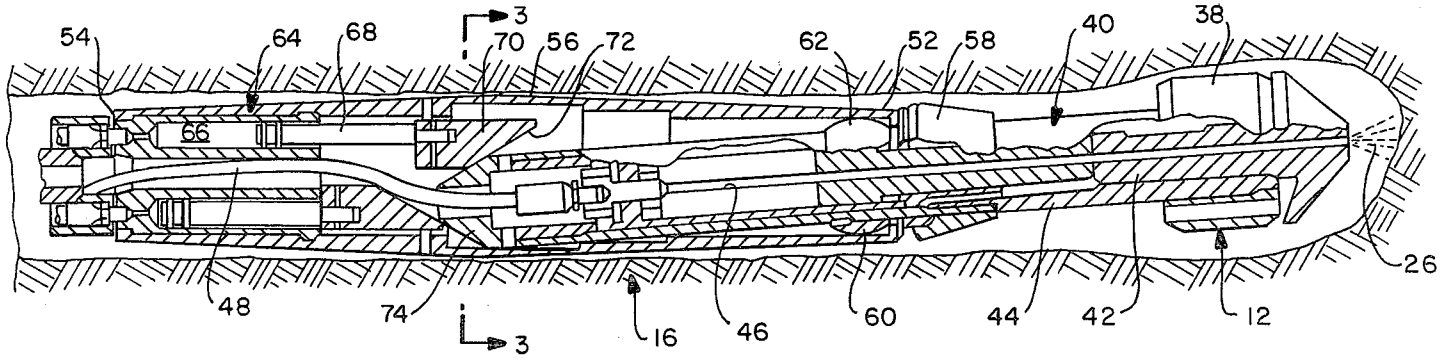
FIG. 1 is an enlarged, partially broken away side elevational view illustrating a portion of the system shown in FIG. 2, specifically its boring head and associated steering section.

Turning now to the drawings, wherein like components are designated by like reference numerals through the various figures, attention is first directed to FIG. 1 which illustrates an overall underground boring system generally designated by the reference numeral 10. This system includes a forwardmost boring head 12 and an adjacent steering section 16 which is designed in accordance with the present invention and which will be described in detail hereinafter. For the moment, it suffices to say that steering section 16 serves to guide boring head 12 along either a straight line path or a curved path as the boring head moves through the ground or earth 18.

With the exception of steering section 16, the various components making up overall system 10 including body head 12 are conventional or may be readily provided by those with ordinary skill in the art. These components include means for moving head 12 and its associated steering section 16 in a generally forward direction through earth 18, for example, cooperating pull and push type of soil gripping arrangements 20 and 22, respectively. These arrangements are disposed behind boring head 12 and steering section 16 within the underground passageway 24 made by the boring head and cooperate with one another and with the wall of the passageway to continuously thrust the boring head and steering section in a generally forward direction. The boring head itself is preferably of the reciprocating, high impact type (as will be described briefly in conjunction with FIG. 2 hereinafter) and also preferably directs one or more jets of water 26 out its front end. Thus, overall system 10 may require both a supply of air under pressure and a suitable air control valve or the like generally indicated at 28 for causing the boring head to reciprocate pneumatically. Both the supply of air and a supply of water for jets 26 could be provided at a common location above ground generally indicated at 30. Obviously, suitable air and water conduits extending between the underground components and location 30 would be necessary. At the same time, suitable control conduits for operating arrangements 20 and 22 from location 30 would be necessary. These various conduits are indicated generally at 32. Moreover, the various components which make up the train of components within passageway 24 may be interconnected together by suitable coupling members 34.

As stated previously, with the exception of steering section 16, the various components making up overall boring system 10 are conventional or may be readily provided by those with ordinary skill in the art. These components may or may not include a reciprocating type of boring head and/or one which includes water jets 26, they may or may not include the particular gripping arrangements as shown, that is, gripping arrangements 20 and 22, and they may or may not include other associated components. However, the overall system is one which causes the boring head and the steering section to move in a generally forward direction as the boring head provides the passageway 24. Since these various components (with the exception of the steering section) do not form part of the present invention, they will not be described any further, although the boring head 12 will be described to the extent necessary to understand the way in which it cooperates with the steering section in accordance with the present invention.

Figure 2:
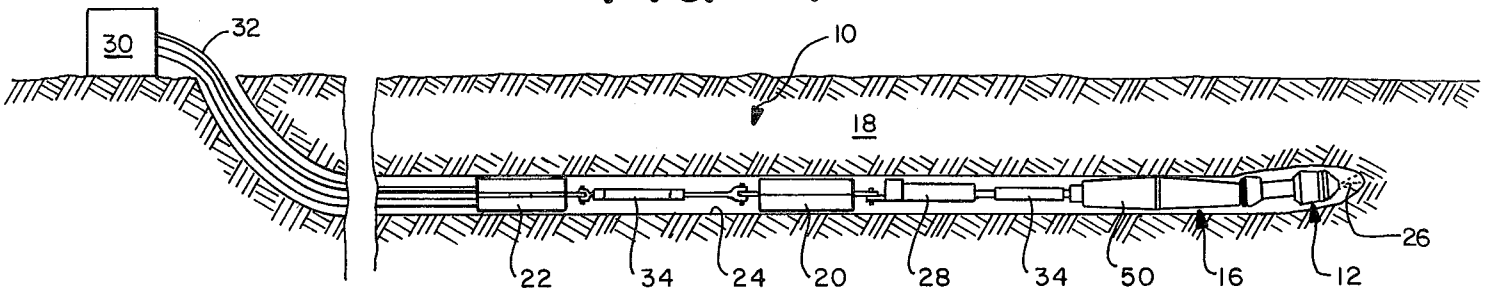
FIG. 2 is a side elevational view of the overall underground boring apparatus disclosed herein and designed in accordance with a preferred embodiment of the present invention.

Turning to FIG. 2, attention is now directed to boring head 12 and steering section 16. As seen in this latter figure, the boring head tapers outwardly and rearwardly from its forwardmost end to a rearwardly extending, cylindrical body 38 which defines the maximum outermost diameter of the boring head. An elongated shaft arrangement generally indicated at 40 and smaller in cross sectional configuration than body 38 is fixedly connected at its front end to and extends rearwardly from the back end of the boring head. Arrangement 40 serves to contain an anvil 42 and cooperating hammer 44 for causing the boring head to reciprocate. In this regard, while not shown, a suitable supply of air controlled by means of previously recited valve 28 is provided through arrangement 40 for operating the anvil and hammer. The shaft arrangement also includes a central passageway 46 in fluid communication with an incoming high pressure water hose 48 for directing water under pressure from its source at location 30 through boring head 12 and out its front end in the form of one or more high pressure jets 26. As will be seen hereinafter, the overall shaft arrangement 40 not only serves as a means of supporting boring head 12 and as a means for containing the various components just recited but also as a component of steering section 16 for causing the boring head to either move along a curved path or in a straight line.

Returning to FIG. 1 in conjunction with FIG. 2, steering section 16 is shown including an outermost, elongated tubular housing 50 having a front end 52 and a rearwardmost end 54. For reasons to be discussed hereinafter, the outermost surface of housing 50 tapers outwardly from these opposite ends to a central point 56 therebetween such that the cross sectional size of the tubular housing at this central point is approximately the same size as the maximum cross sectional configuration of the boring head.

As seen only in FIG. 2, shaft arrangement 40 extends partially into housing 50 through its front end. An outer collar 58 is disposed around an external section of the shaft arrangement and immediately in front of housing 50 so as to prevent the latter from sliding further into the housing. A second collar 60 located within housing 50 is fixedly disposed around an internal section of shaft arrangement 40 adjacent the front end 52 of the housing. This latter collar includes an outermost surface 62 which is formed from a segment of a sphere. Surface 62 engages a cooperating inner surface segment of housing 50 for supporting shaft arrangement 40 and therefore boring head 12 for limited pivotal movement relative to housing 50. More specifically, because of the spherical shape of surface 62, shaft arrangement 40 is able to pivot about any axis which is coextensive with any diameter forming part of surface 62. In this way, boring head 12 is movable relative to housing 50 to any point on a circle perpendicular to and radially outward of (but concentric with) housing 50.

The purpose for the pivotal movement of boring head 12 is to allow it to move in a curved path as it is driven in a generally forward direction through the earth. More specifically, so long as shaft arrangement 40 is maintained in coaxial relationship with housing 50, the entire train of components including the boring head will move along a generally straight line path. By pivoting shaft arrangement 40 and therefore boring head 12 relative to the housing, the boring head and therefore the entire train of underground components are caused to turn in the direction of the pivot. For example, as illustrated in FIG. 1, when the front end of the shaft arrangement and the boring head are pivoted downward relative to the housing, the entire train of components will curve in a downward direction. On the other hand, as illustrated in FIG. 2, when the front end of the shaft arrangement and the boring head are pivoted in an upward direction, the entire train of components will turn in an upward direction. By providing spherical surface segment 62, the train of components can be made to not only turn downward or upward but also to the left or to the right or at any angle therebetween.

Moreover, by designing the outer surface of housing 50 in the tapered fashion described previously, the boring head can be made to make sharper turns than would be possible using a non-tapered housing, that is, one having a uniform cross section along its entire length. This is best illustrated in FIG. 2. As seen there, as the front end of shaft arrangement 40 is pivoted upwards and its rear end moves downwards, the front end of housing 50 is caused to move downwards while its rear end moves upwards, all within passage 24. This is possible because the maximum cross section of the passageway is approximately equal to the maximum diameter of boring head 12 and therefore approximately equal to the maximum diameter of the housing at central point 56. Therefore, since the front and rear ends of the housing are smaller in cross section there is room within the passageway to allow these ends to pivot. If the housing and a uniform cross section along its length, it could not pivot in this way. Finally, because the housing is allowed to pivot in opposition to the pivoting motion of shaft arrangement 40, it reduces the radius of curvature defining the turn made by the boring head over what the radius would be if only the shaft arrangement were to pivot.

In order to pivot shaft arrangement 40 in a controlled fashion for guiding boring head 12 as the latter moves through soil 18, steering section 16 includes an arrangement 64 of piston/cylinder units disposed within housing 50 directly behind the back end of shaft arrangement 40. Arrangement 64 includes four cylinder openings 66 and associated pistons 68 which extend parallel with and which are equally circumferentially spaced around the axis of housing 56. While the piston/cylinder units may be operated electrically or pneumatically, they are preferably individually operated hydraulically in the manner to be described hereinafter with respect to FIGS. 6 and 7. For the moment, it suffices to say that each piston is caused to move between a retracted position within its associated cylinder opening and an extended position closer to the front end of the housing. Each piston may be individually moved from its retracted position to its extended position (while the others remain in their retracted positions), two adjacent pistons may be moved simultaneously to their extended positions, or all four pistons may be moved simultaneously to extended positions. A source of hydraulic fluid and suitable control means disposed at location 30 may be provided for accomplishing this in the manner to be described with respect to FIGS. 6 and 7.

Figure 3:
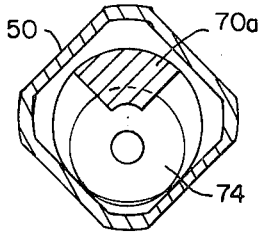
FIG. 3 is a cross sectional view of the steering section illustrated in FIG. 2, and taken generally along line 3—3 in FIG. 2.
Figure 4:
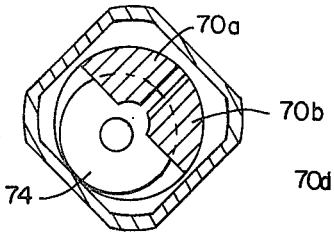
FIG. 4 is a view similar to FIG. 3 but illustrating the steering section of the overall apparatus in a different operating position.
Figure 5:
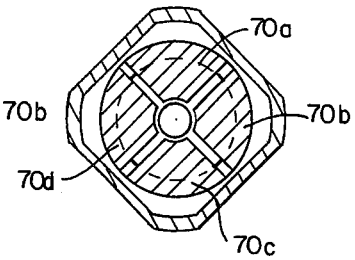
FIG. 5 is also a view similar to FIG. 3 but illustrating the steering section of the overall apparatus in still a different operating position.

As illustrated in FIG. 2 in conjunction with FIGS. 3–5, the front end of each piston 68 carries a shaft engaging member 70 having an inwardly and rearwardly extending surface 72. The rearwardmost end of shaft 40 includes a rearwardly and inwardly tapering circumferential surface 74 which is adapted to engage the individual surfaces 72 of members 70 when associated pistons are in their extended positions. FIG. 3 shows a top member **70*a* in its extended position while the other members 70*b*, 70*c*, and 70*d* (see FIG. 5) remain in their retracted positions. This causes the top member to engage surface 74 in a way which causes the bottom end of shaft arrangement 40 to pivot downward and the top end and boring head 12 to pivot upwards. In FIG. 4, the top member 70*a* and the right hand member 70*b* (as viewed in FIG. 4) are shown in their extended positions while the remaining two members 70 are shown in their retracted positions. This causes the back end of shaft arrangement 40 to be pivoted downward and to the left while the top end moves upward and to the right. It should be apparent that the bottommost member 70*c* can be moved to its extended position only for pivoting shaft arrangement 40 in a manner opposite to that shown in FIGS. 2 and 3, and that any combination of two adjacent members 70 can be extended while the other two remain retracted for pivoting the shaft arrangement in various other ways. In addition, FIG. 5 shows all four of the members 70*a*, 70*b*, 70*c* and 70*d* in equally extended positions. As will be seen hereinafter, this causes the shaft arrangement to be maintained in coaxial relaionship with the housing 50** for maintaining movement of the boring head in a straight line path.

Figure 6:
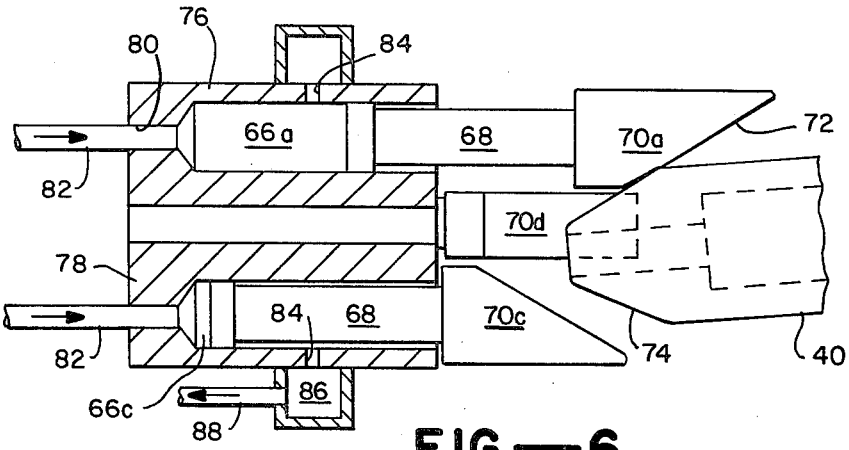
FIG. 6 is an enlarged diagrammatic view depicting a portion of the steering section shown in FIG. 2 and specifically illustrating how the boring head is caused to turn in a controlled fashion.
Figure 7:
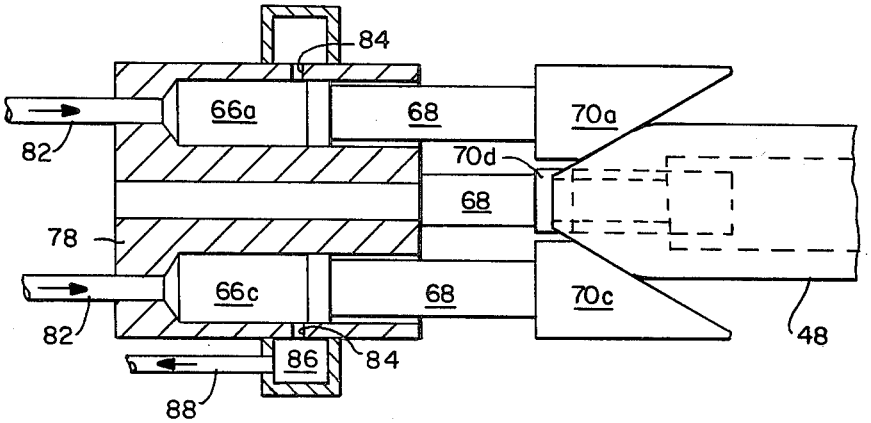
FIG. 7 is a view similar to FIG. 6 but illustrating how the steering section of the overall apparatus causes the boring head to remain in a straight line path of movement.

Referring now to FIGS. 6 and 7, attention is directed to the way in which each of the cylinders 68 is caused to move between its extended and retracted positions. This is shown in the figures diagrammatically in order to fully understand the present invention. It is to be understood that the various means to be described with regard to these latter figures are incorporated in one form or another in system 10 as it actually exists. Referring first to FIG. 6, two of the four cylinder openings 66 (**66*a*, 66*c* for consistency) are shown in a common cylinder body 76 having a through opening for the passage of previously described hose 48 and other necessary components. The back end of each opening 66 includes an inlet port 80 for hydraulic fluid. Each inlet port is maintained and in fluid communication with an associated hydraulic fluid inlet hose 82 which extends back to the source of hydraulic fluid at location 30. For reasons to be described below, each cylinder opening 66 also includes a side port 84 which opens out into a common manifold 86 for all of the side ports. A single hydraulic fluid return hose 88 extends between manifold 86 and the source of hydraulic fluid at location 30**.

At location 30, a set of controls are provided for operating the arrangement of piston/cylinder units. These controls include a suitable valve associated with each hydraulic fluid line 82 for either opening or closing the line to the source of hydraulic fluid and a single valve for either opening or closing return line 88 to the fluid source. When each line 82 is closed to the fluid source, its associated opening 66 is opened to ambient pressure. When line 88 is closed, any hydraulic fluid under pressure within an associated cylinder opening 66 is prevented from passing out of the opening through side port 84. On the other hand, when line 88 is maintained open, as fluid under pressure enters its associated opening 66, it passes out through the opening 84 and line 88. Thus, as illustrated in FIG. 6, with all of the lines 82 closed except for the upper line and with line 88 closed, fluid under pressure enters the top cylinder opening 66 causing the top piston 68 to move to its extended position. This, in turn, causes its associated member **70*a* to engage the back end of shaft arrangement 40 in the manner described previously. By opening two adjacent ones of the four lines, two adjacent pistons can be made to move to their extended positions. In order to cause the individual pistons to move back to their retracted positions, the overall arrangement of piston and cylinder units could include positive means to do this. However, in the embodiment illustrated, it is merely necessary to open the lines 82** to ambient pressure (e.g., closing them to the hydraulic fluid source). The shaft arrangement itself will easily move these pistons back as others are pushed forward.

Referring to FIG. 7, attention is now directed to the way in which the shaft arrangement 40 and boring head 12 are maintained in coaxial relationship with housing 50. As seen in this latter figure, all of the pistons are located in equally extended positions. This is accomplished by opening all of the lines 82 to the source of hydraulic fluid so that the latter enters all of the cylinder openings 66. At the same time, the outlet line 88 is opened. In this way, hydraulic fluid enters all of the cylinders 66 so as to force all of the pistons to positions beyond side ports 84. Once the side ports become exposed to the cylinder openings 66, the fluid within each cylinder opening passes out into the manifold 86 and back out through line 88. Thus, all of the cylinders extend out equidistant, that is, no further out than just beyond the side ports, as shown in FIG. 7. This ensures that all of the pistons are maintained the same distance beyond their cylinder openings and thus engage surface 74 of shaft arrangement 40 so as to maintain the latter in parallel relationship with the pistons and hence coaxially with housing 50. This provides positive means for maintaining the movement of boring head 12 in a straight direction.

What is claimed is:

1. An underground boring apparatus comprising a boring head, elongated means connected at its front end to and extending rearwardly from said boring head for supporting the latter, means for moving said boring head and supporting means in a generally forward direction through the earth, means supporting said elongated means at a predetermined point along its length for pivotal movement about at least one axis whereby to cause said boring head to pivot about said axis, and means for pivoting said supporting means about said axis and for maintaining the latter in any one of its pivoted positions during movement through the earth whereby to guide the boring head through both linear and non-linear paths in the earth, said supporting means supporting said elongated means for pivotal movement about any one of a number of axes sufficient to cause said boring head to be moved to any point on a circle radially larger than its own cross sectional configuration, said supporting means including an outer collar fixedly connected to and extending around said elongated supporting means at said point, said collar having an outer surface which defines the segment of a sphere, and a tubular housing containing said collar and supporting the latter for pivotal movement about any one of said axes.

2. An apparatus according to claim 1 wherein said collar is located at an intermediate point along the length of such supporting means and wherein said tubular housing contains said collar and the adjacent rearward section of said supporting means, said housing having an outermost surface which tapers outwardly from opposite ends thereof to an intermediate point such that the cross sectional size of said tubular housing at said last-mentioned point is approximately the same size as the maximum cross section of said boring head.

3. An apparatus according to claim 2 wherein said pivoting means includes a plurality of piston/cylinder arrangements, means for moving said pistons individually between extended and retracted positions and means responsive to the positions of said pistons for causing said supporting means to pivot to particular positions about particular axes depending upon which piston or pistons are extended and the amount they are extended.

4. An apparatus according to claim 3 wherein said means for moving said pistons individually includes means for moving all of them to equivalent extended positions and for maintaining the pistons in these positions so as to maintain said supporting means and boring head in axial alignment with said tubular housing whereby to cause said boring head to follow a linear path through the earth.

5. An underground boring apparatus comprising a boring head, elongated means connected at its front end to end extending rearwardly from said boring head for supporting the latter, means for moving said boring head and supporting means in a generally forward direction through the earth, an elongated tubular housing having an opened front end and containing a rearward end section of said elongated means therein, means disposed within said housing and supporting said elongated means at a predetermined point along its contained back end section for pivotal movement about at least one axis relative to said housing whereby to cause said boring head to pivot about said axis, and means for pivoting said supporting means about said axis and for maintaining the latter in any one of its pivoted positions during movement through the earth whereby to guide the boring head through both linear and non-linear paths in the earth, said pivoting means including a plurality of piston/cylinder arrangements, means for moving said pistons individually between extended and retracted positions parallel to the axis of said housing, means responsive to the positions of said pistons for causing supporting means to pivot to a particular position about the axis, and means for moving all of the pistons to equivalent extended positions and for maintaining the position in these latter positions so as to maintain said supporting means and boring head in axial alignment with said tubular housing whereby to cause said boring head to follow a linear path through the earth.

6. An apparatus according to claim 5 wherein said housing has an outermost surface which tapers outwardly from opposite ends thereof to an intermediate point such that the cross sectional size of said tubular housing at said intermediate point is approximately the same size as the maximum cross section of said boring head.

7. An underground boring apparatus comprising: a boring head; elongated means connected at its front end to and extending rearwardly from said boring head for supporting the latter; means for moving said boring head and supporting means in a generally forward direction through the earth; means supporting said elongated means at a predetermined point along its length for pivotal movement about at least one axis whereby to cause said boring head to pivot about said axis; and means for pivoting said supporting means about said axis or axes and for maintaining the latter in any one of its pivoted positions during movement through the earth whereby to guide the boring head through both linear and non-linear paths in the earth, said pivoting means including a plurality of piston/cylinder arrangements, means for moving said pistons individually between extended and retracted positions, means responsive to the positions of said pistons for causing said supporting means to pivot to particular positions about said axis of axes depending upon the positions of said pistons, and means for moving all of said pistons to equivalent extended positions and for maintaining the pistons in these equivalent positions so as to maintain said supporting means and boring head in a fixed position such that they follow a linear path through the earth.

8. An underground boring apparatus comprising: a boring head; an elongated shaft arrangement connected at its front end to and extending rearwardly from said boring head for supporting the latter; an elongated tubular housing having an opened front end and containing a back end segment of said shaft arrangement therein such that a front end segment of said shaft arrangement and said boring head are disposed in front of said housing, said housing having an outermost surface which tapers outwardly from opposite ends thereof to a central point along its length such that the cross sectional size of said housing at said point is approximately the same size as the maximum cross sectional configuration of said boring head; a circumferential collar located within said tubular housing adjacent the front end of the latter and fixedly disposed around a circumferential segment of said shaft arrangement within said housing, said collar having an outer surface which defines the circumferential segment of a sphere, said outer surface cooperating with said tubular housing for supporting said shaft arrangement for pivotal movement about any axis coextensive with a diameter of said spherical segment whereby to cause said boring head to be movable to any point on a circle normal to and radially outwardly of said tubular housing; means for pivoting said shaft arrangement about any one of said axes and for maintaining said shaft arrangement in any one of its pivoted positions, said pivoting means including four pistons/cylinders arrangements disposed within and extending parallel with said tubular housing and equally circumferentially spaced about the axis of the latter rearwardly of said shaft arrangement, means for moving said pistons individually between extended and retracted positions in directions parallel to the axis of said housing, means including cooperating inclined surfaces responsive to the positions of said pistons for causing said shaft arrangement to pivot to particular positions about particular axes depending upon the positions of said pistons relative to one another, and means for moving all of said pistons to equivalent extended positions and for maintaining the pistons in these positions so as to maintain said shaft arrangement and boring head in axial alignment with said tubular housing; and means for moving said boring head, shaft arrangement and tubular housing in a generally forward direction through the earth whereby the position of said shaft arrangement and boring head relative to said tubular housing determines the specific path taken by these components as they move through the earth.

* * * * *